United States Patent [19]

Galperin et al.

[11] 4,202,383

[45] May 13, 1980

[54] APPARATUS FOR WINDING A WEFT THREAD ONTO SPOOLS OF CARRIERS IN TRAVELLING-WAVE LOOMS

[76] Inventors: Alexandr L. Galperin, ulitsa Moldagulovoi, 10, korpus 3, kv. 166; Albert S. Serebryannikov, ulitsa Krasikova, 11, kv. 63; Eduard A. Onikov, ulitsa Panferova, 5, korpus 2, kv. 106; Alexandr A. Zabotin, Belyaevo-Bogorodskoe, kvartal 45, korpus 26, kv. 87, all of Moscow; Evgeny D. Loschilin, Kashirskoe shosse, 36, kv. 87, Domodedovo Moskovskoi oblasti, all of U.S.S.R.; Nicola Santucci, Viale del Industria 32, Schio (Vicenza), Italy

[21] Appl. No.: 941,237

[22] Filed: Sep. 11, 1978

[51] Int. Cl.[2] ..... D03D 47/26

[52] U.S. Cl. ..... 139/436; 139/224 R

[58] Field of Search ..... 139/436, 224 R, 224 A

[56] References Cited

U.S. PATENT DOCUMENTS

| | | | |
|---|---|---|---|
| 3,835,893 | 9/1974 | Galperin et al. | 139/436 |
| 3,943,976 | 3/1976 | Vilaseca | 139/436 |
| 4,076,051 | 2/1978 | Zabotin et al. | 139/436 |

*Primary Examiner*—Henry Jaudon

*Attorney, Agent, or Firm*—Steinberg & Blake

[57] ABSTRACT

In the proposed apparatus for winding a weft thread onto spools of carriers, there is provided a disk rotatable in the horizontal plane on which are mounted constantly meshed satellite gears and winding members rotated by these satellite gears which engage, in a zone of winding of the weft thread, a stationary toothed sector arranged coaxially with the rotatable disk. In addition, provided in the apparatus are also a device for retaining the winding members in a preset position after the satellite gears disengage from the toothed sector and a device for gradual starting of the winding members and for stopping them in a predetermined position which precludes impacts and breakage of teeth at the engagement of the satellite gears with the toothed sector. This arrangement makes it possible to increase the speed of winding of the weft thread onto the spools of the carriers and to wind a required amount of the weft thread onto the spools of the carriers.

6 Claims, 3 Drawing Figures

APPARATUS FOR WINDING A WEFT THREAD ONTO SPOOLS OF CARRIERS IN TRAVELLING-WAVE LOOMS

FIELD OF THE INVENTION

The present invention relates to travelling-wave looms and, more particularly, it relates to apparatus for winding a weft thread onto spools of carriers used in these looms, wherein the carriers with a reserve of the weft thread wound onto the spool move along a closed trajectory in a horizontal plane, a straight portion of this trajectory passing through a looming-up zone, i.e. through a travelling-wave shed.

BACKGROUND OF THE INVENTION

Prior art apparatus for winding a weft thread onto spools of carriers are disposed within an arcuate portion of a closed trajectory of movement of the carriers and include a disk rotatable in a horizontal plane, a stationary toothed sector installed coaxially with the disk, and winding members driven into rotation by satellite gears periodically engaging the stationary toothed sector.

The winding members of a great variety of designs are constantly meshed with the satellite gears and, like the latter, are mounted on the rotatable disk. The surface of the toothed sector, along which the satellite gears run, determines the extent of a winding zone, i.e., determines the portion of the closed trajectory within which the weft thread is wound onto the spools of the moving carriers. In this case, irrespective of the design of the winding members, the methods whereby the end of the weft thread is wounded and gripped during winding and design of the devices used to propel the carriers, the winding process begins immediately upon the stationary toothed sector being engaged with the satellite gears which are rotated by the disk and terminates immediately upon the satellite gears and the toothed sector being disengaged. Next, with the disk rotating, the winding members, along with the satellite gears, shift into the winding zone once more, while the carriers with a reserve of the weft thread move into the loom shed.

However, since prior to the engagement of the satellite gears with the toothed sector these satellite gears are in an arbitrary position, there is a probability that any tooth of the satellite gear may collide with a tooth of the sector, which, at high running speeds of the loom, may result in impacts and breakage of the teeth.

Inasmuch as the satellite gears before engaging the toothed sector are stationary, their rotational speed, after meshing therewith, jumps practically instaneously from zero to maximum, thereby causing impacts and premature wearing of the teeth.

Besides, after the satellite gears disengage from the toothed sector, they continues rotating due to inertia before stopping completely and, while rotating due to inertia they continues winding the weft thread onto the spool, since the stoppage by inertia occurs each time at different moments, the length of the wound weft thread varies in each instance, which results in great losses in the weft. Also widely known are toothed winding mechanisms with a device for stopping the same at a definite predetermined position, wherein there are provided a driven gear with two pins and a driving gear with an incomplete number of teeth, combined with a cam. The cam is located in that part of the gear where there are no teeth. Both pins are adapted to cooperate with the cam. As the mechanism operates and the gears are engaged, the driven gear rotates at a constant angular speed. In the process of this rotation, the cam engages two pins, whereby the driven gear is caused to continue the rotation. At this time due to the part without teeth on the driving gear and due to the profile of the cam, the driven gear gradually reduces its speed till a momentary stop. Thereafter, the speed of the driven gear increases to a maximum, the teeth of the driving gear engage the teeth of the driven gear, the cam disengages from the pins and the driven gear again starts rotating at a constant angular speed. While the driving gear makes one revolution, the driven gear makes one revolution and a momentary stop. The profile of the cam ensures impact-free operation of the mechanism. In this mechanism, the probability of collision of the tooth of the driven gear with the tooth of the driving gear is precluded, the mechanism providing for impact-free operation and preventing rotation of the driven gear due to inertia after being disengaged from the driving gear.

However, this apparatus is capable of stopping the driven gear only for a moment. Therefore, it cannot be practically used in the apparatus for winding the weft thread, wherein the winding members must be fixed in a definite position for a long time, i.e., for at least 180° of the disk turn. At the same time, it proves impossible to modify the profile of the cam of this toothed mechanism so as to provide for a prolonged dwell of the driven gear.

SUMMARY OF THE INVENTION

It is an object of the present invention to obviate the above disadvantages.

The principal object of the invention is to increase the speed of winding of a weft thread onto spools of carriers in travelling-wave looms, thereby increasing the efficiency of these looms.

Another object of the invention is to improve the reliability of operation of the apparatus for winding of the weft thread by precluding inelastic impacts at the point of engagement of the satellite gears with the stationary toothed sector in the apparatus for winding the weft thread.

Still another object of the invention is to reduce weft losses by winding a definite amount thereof onto the spools of the carriers.

These and other objects are attained in an apparatus for winding a weft thread onto spools of carriers in travelling-wave looms, comprising a disk rotatable in a horizontal plane, which disk carries satellite gears and winding members rotated around their axles by these satellite gears engaging, within a zone of winding of the weft thread, a stationary toothed sector arranged coaxially with the disk, wherein, in accordance with the present invention, there is provided a device for retaining the winding members in a preset position after the satellite gears disengage from the toothed sector. The device includes a stationary fixing sector arranged diametrically opposite the toothed sector, and lugs secured on the satellite gears and cooperating, when the latter are moved by the disk, with the periphery of the fixing sector. The device for gradual starting of the winding members and stopping them in a predetermined position, includes two stationary cams, respectively, for gradual starting and for stopping the winding members, mounted above the portions of changeover of the satellite gears, respectively, from the fixing sector to the toothed one and from the toothed sector to the fixing one. A plurality of pairs of pins, corresponding in number to the winding members are provided, each pair being mounted on a respective satellite gear, one pin of the pair being adapted to cooperate with the cam for starting, and the other pin being adapted to cooperate with the cam for stopping.

Thus, the presence in the apparatus of the device for gradual starting of the winding members and for stopping them in a predetermined position makes it possible to noticeably improve the operation of the apparatus as a whole and to increase the winding speed. At the same time, the cam for gradually stopping the winding members in a predetermined position aids in bringing the lugs on the satellite gears to the fixing disk, which thereby prevents the satellite gears from being turned after disengagement of the toothed sector as well as from being accidentally turned at dwell over the whole length of contact of the lug with the fixing disk. This precludes winding of a surplus length of the weft thread onto the spools of the carriers. The presence of the cam for gradual starting of the winding members helps to correctly mesh the satellite gears with the stationary toothed sector and, since at the moment of engagement the satellite gears are already rotating at a maximum speed, the impact at the initial meshing moment is avoided and the increase in the winding speed of the weft thread is allowed for, with the reliability of operation of the apparatus as a whole being secured.

Accordng to an alternative embodiment of the invention, the cams for gradual starting and stopping and the end faces of respective pins of the pairs are positioned in different planes with respect to the toothed sector. This makes it possible to maintain, between the cams for gradual starting and stopping and respective pins, the pressure angles within the tolerable limits over the whole length of their contact and, therefore, ensures the required speeds and reliability of operation of the device for gradual starting of the winding members and stopping thereof in a predetermined position.

According to another embodiment of the invention, the cams for starting and stopping are made as strips extending in the horizontal planes, with guiding slots for the relevant pins of the satellite gears made on the underside thereof.

It is preferable that the length and shape of the guiding slots of the strips be chosen so as to provide for gradual increasing or decreasing of the rotational speed of the winding members and fixing thereof in a predetermined position for the satellite gears and the toothed sector to mesh without impact.

According to still another embodiment of the invention, the fixing sector is seated on a common axle with the toothed sector beneath the latter, which allows easy adjustment of the starting and termination moments of winding by turning this axle together with the fixing and toothed sectors, facilitates servicing of the apparatus due to the pair of the pins located, in this case, on the upper end face of the satellite gears, which is convenient for observing the cams being mounted, and simplifies the apparatus, since the pair of pins and the lugs are easily arranged on each satellite gear.

According to yet another embodiment of the invention, the lug of the satellite gears is formed by at least two rollers free to rotate and mounted on the lower end face of the satellite gears.

Thus, the proposed apparatus for winding the weft thread aids in increasing the efficiency of the travelling-wave loom. Moreover, by way of changing the length of the effective surface of the toothed and fixing disks it is possible to provide for any relationship between the duration of the cycle of rotation of the gears around their own axles and the duration of the cycle of dwell, thereby providing for a possibility for winding any required length of the weft thread at any relative duration of the winding cycle.

BRIEF DESCRIPTION OF THE DRAWINGS

Given below is a detailed description of the present invention with reference to the accompanying drawings, wherein.

DETAILED DESCRIPTION OF THE INVENTION

Figure 1:
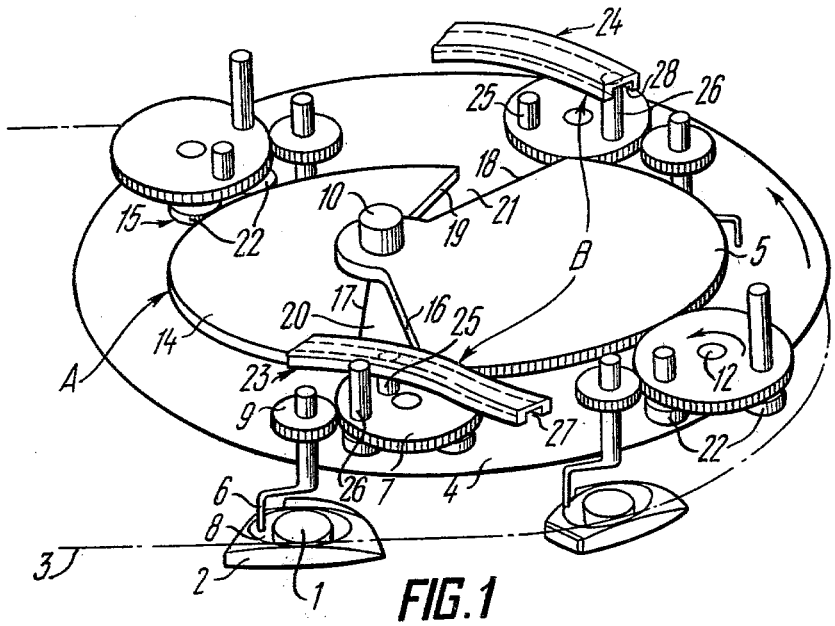
FIG. 1 is a schematic perspective view of a part of an apparatus for winding according to the present invention.

The apparatus for winding a weft thread onto spools 1 (FIG. 1) of carriers 2 overlies an arcuate portion of a trajectory 3 of movement of the carriers 2, shown by the dot-and-dash line, and includes a disk 4 rotatably mounted in a horizontal plane, a stationary toothed sector 5, winding members 6, satellite gears 7, a device A for retaining the winding members in a preset position after the satellite gears 7 disengage from the toothed sector 5, and a device B for gradually starting and stopping the winding members 6 in a predetermined position.

Since a description of the structure of the winding members 6, the manner in which the weft thread is wound onto the spools of the carriers and the structure of the apparatus for moving the carriers along the trajectory 3 are well-known and conventional and bear no relevance to the features of the present invention, a detailed description thereof is not set forth. For example, winding members illustrated in U.S. Pat. 3,943,976 may be utilized. Alternatively, the known curved hollow tubes as shown in FIG. 1 through which the weft thread passes and which, in the process of winding, enter a cavity 8 of the carriers as sown in FIGS. 1, 2 and rotate around the spool 1 with the end of the weft thread being nipped by a grip may be utilized. In the latter case, it is essential that a gear 9 arranged on each winding member 6 be constantly meshed with the satellite gear 7. In totality, each gear 9, while being constantly meshed with the satellite gear 7, forms a train of satellite gears 7, 9, since these gears start rotating around their axles only when one of them (the satellite gear 7) engages the toothed sector 5. As a result, the length of the toothed surface of the toothed sector 5 determines the zone of winding of the weft thread.

It is evident that in the apparatus for winding the weft thread onto the spools of the carriers there are provided all necessary and conventional devices or mechanisms for cutting the wound weft thread, grips for the ends of the cut weft threads, as well as a drive for bringing the disk 4 into rotational motion, etc.

Figure 2:
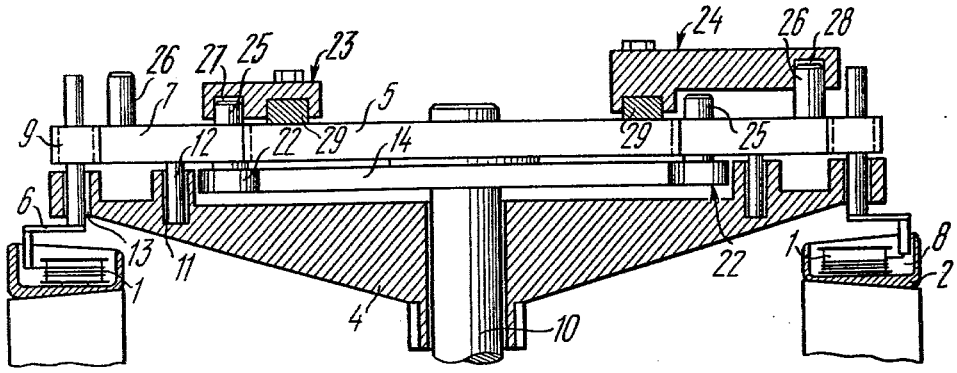
FIG. 2 is a partial section of the apparatus of FIG. 1 along a toothed sector illustrating a cam for gradual starting and stopping winding members.

The disk 4 (FIG. 2) is loosely seated on a stationary axle 10 to obtain rotational motion from any known drive not shown. Bores 11 are formed at the periphery of the disk 4, for accommodating axles 12 of respective satellite gears 7 and through bores 13 through which the shafts of the winding members 6 pass as is shown in FIG. 2.

The device A (FIG. 1) for retaining the winding members 6 in a preset position after the satellite gears 7 disengage from the toothed sector 5 comprises a fixing sector 14 and lugs 15 secured on the satellite gears 7. The stationary fixing sector 14 is installed diametrically opposite the toothed sector 5 below the latter and on the axle 10 which is common for both of them, as is shown in FIGS. 1 and 2.

Thus, as seen in the drawings, the shaft 10 extends through a central bore formed in disk form, the latter being rotatably mounted on the shaft 10 by conventional apparatus, such as a bearing (not shown). Lower portions of shafts 12 which are centrally affixed at their upper ends 2 and support respective satellite gears 7 are rotatably carried in bores 11 formed in the peripheral region of disk 4 by conventional apparatus, such as bearings (not shown). Thus, the disk 4 is rotatably mounted in shaft 10 and in turn rotatably supports the satellite gears 7 by means of shafts 12.

Figure 3:
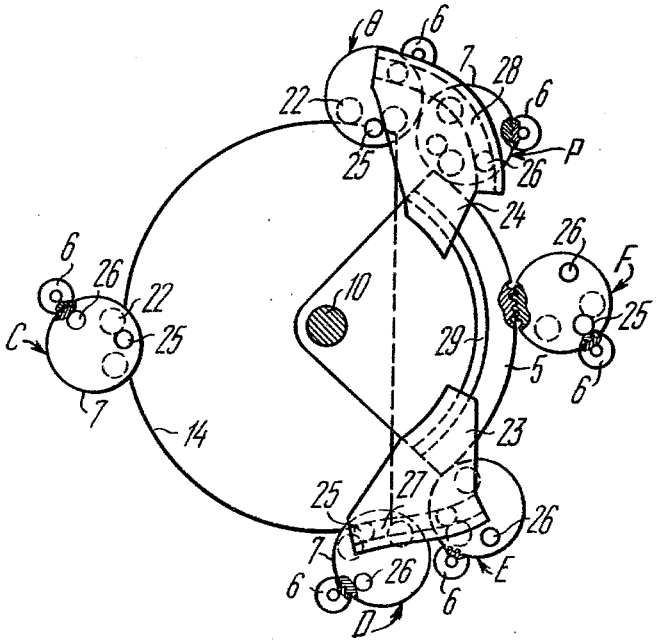
FIG. 3 is a view similar to FIG. 1, illustrating an alternative embodiment of attachment of the cams for gradually starting and stopping of winding members in conjunction with the stationary toothed sector.

The relative dimensions of the toothed sector 5 (FIG. 1) and fixing sector 14 may be varied by suitably pivoting one with respect to the other about the axis of shaft 10, such relative dimensions depending on the chosen winding mode, as is shown in FIGS. 1 and 3. Gaps 20 and 21 are formed between the respective butt edges 16, 17, 18 and 19 of the fixing and toothed sectors 14, 5. Each lug 15 is located at the lower end face of the satellite gear 7 and by at least two freely rotating rollers 22 cooperating, when the satellite gears 7 are displaced by the disk 4, with the periphery of the fixing sector 14.

Thus, referring to the embodiment of the invention illustrated in the drawings, each lug 15 comprises a pair of rollers 22 rotatably mounted on the bottom portions of respective shafts which are affixed at their upper regions to a respective satellite gear 7. As seen in FIGS. 1 and 3, when a satellite gear is moved over a pair adjacent to the periphery affixing sector 14 by rotating disk 4, the peripheral surfaces of both of the rollers 22 engage the periphery of the fixing sector 14 so that the particular satellite gear 7 is prevented from rotating on its shaft 12.

The device B for gradually starting the winding members 6 and stopping them in a predetermined position includes two elongated slatted cams 23 and 24 for starting and stopping the winding member 6, respectively, and a pairs of pins 25 and 26 associated with each winding member. Each pair of pins 25 and 26 is mounted on a respective satellite gear 7 on the upper end face thereof, the pin 25 of the pair being appropriately located and of an appropriate height so as to cooperate with the cam 23 i.e., so that the upper end is received within the slot of cam 23, for starting at the beginning of winding of the weft thread. The pin 26 is alo appropriately located and has an appropriate height (greater than the height of pin 25 in the illustrated embodiment) to interact with the slot of cam 24 for stopping at the end of winding of the weft thread.

The cam 23 is stationary above the portion wherein the satellite gears 7 transfer from the fixing sector 14 to the toothed sector 5, i.e.., above the gap 20, thereby partially overlapping these sectors in plan as is shown in FIG. 3 along the trajectory of movement of the satellite gears 7. The cam 24 is fixedly mounted above the portion wherein the satellite gears 7 change over from the toothed sector 5 to the fixing sector 14, i.e., above the gap 21, thereby partially overlapping these sectors in plan, as is shown in FIG. 3.

The cams 23 and 24 are located relative to the toothed sector 5 in different vertical planes parallel to each other, so that the cam 23 (FIG. 2) is located somewhat lower than the cam 24, the end faces of the pins 25 and 26, respectively, being also disposed in different planes for interacting with a respective cam, as a result of which the pin 25 is smaller than the pin 26.

The cams 23 and 24 are made as strips extending in a horizontal plane, on the underside of each of them there is made a guiding slot 27 and 28, respectively, the slot 27 of the cam 23 beng intended to receive the pin 25 and the slot 28 of the cam 24 beng intended to receive the pin 26.

The shape and length of the guiding slots 27 and 28 (as is shown in FIGS. 1 and 3) of the strips are chosen so that the rotational speed of the satellite gears and, accordingly, of the winding members 6 is smoothly increased or decreased, and they are fixed in a predetermined position for the satellite gears to engage the toothed sector 5 without impacts. This condition is attained by a calculation method known to those skilled in the art. By similar calculations, each pin 26 is appropriately located on its respective satelite gear so that upon the gear reaching the end of the toothed sector 5, pin 26 will enter into the slot 28 of cam 24.

The cams 23 and 24 may be secured by any known manner to any stationary part of the winding apparatus. However, it is most advantageous to secure the cams 23 and 24 on the toothed sector 5. In this case, as the cams are made as strips, they have a somewhat elongated form, as is shown in FIG. 3, in distinction to the form of the cams shown in FIG. 1. Therewith, the cams 23 and 24, according to FIG. 3, are attached on a lug 29 of the toothed sector 5 in any known way.

The proposed apparatus operates as follows.

While at dwell, the satellite gears 7 (ref. point C of FIG. 3), by virtue of the engagement of rollers 22 with the periphery of fixing sector 14, do not turn about their axles but rotate together with the disk 4 around its axle 10. In this case, the rollers 22 run over the periphery of the fixing sector 14, thereby preventing the satellite gears from being spontaneously turned. The satellite gears 7 are appropriately oriented by rollers 22 so that immediately upon at least the leading roller 22 clearing the periphery of fixing sector 14; the pin 25 enters the guiding slot 27 of the cam 23 (ref. point D) after which the fixing sector 14 is interrupted. Then, the satellite gears start accelerating (ref. point E), while the radius of the profile of the slot 27 of the cam 23 gradually increases, due to which the rotation, via the pin 25, is transmitted to the satellite gear 7 and the winding member 6, as a result of which the winding of the weft thread onto the spool of the carrier is initiated. The satellite gear 7 moves adjacent to the gap 20 during the accelleration phase so that the gear is not constrained from rotating under the influence of cam slot 27. The guiding slot 27 of the cam 23 ensures impact-free acceleration of the gears 7 up to the maximum speed and accurate engagement thereof with the toothed sector 5 which occurs immediately upon pin 25 exiting from slot 27. The profile of the slot 27 of the cam 23 is designed so that the gear 7 attains the maximum speed just before it meshes with the toothed sector 5. After the satellite gear 7 is meshed with the toothed sector 5, the cam 23 terminates and the satellite gears 7 start rotating at a constant speed around their axles due to engagement with the toothed sector 5, while continuing winding the weft thread (ref. point F). In the course of this rotation, the pin 26 enters the guiding slot 28 of the cam 24 (ref. point P). Thus, upon reaching the end of the toothed sector 4, the satellite gear 7 is located through the appropriate calculations mentioned above in a manner such that the pin 26 is aligned with the entrance area of slot 28 of cam 24. Thus, immediately after termination of the toothed sector 5 the satellite gear 7, owing to the profile of the slot 28, is decelerated by the cam 24 till it comes to a stop at a predetermined position and the winding of the weft thread is terminated (ref. point Q). In this case, the pin 25 passes beneath the cam 24 without cooperating with the latter due to its relatively short length. After the satellite gears 7 have stopped completely, the rollers 22 come again into contact with the fixing sector 14 and the cam 24 is interrupted. Thereafter, the process repeates itself. The disk 4 may carry several satellite gears 7 and the winding members 6 requiring one fixing 14 and one toothed sector 5 and two cams 23 and 24, respectively.

What is claimed is:

1. An apparatus for winding a weft thread onto spools of carriers in travelling-wave looms, comprising: a disk rotatable in a horizontal plane; a means for rotating said disk; winding members rotating around their axles, intended for winding of the weft thread onto spools of carriers and mounted on said disk; satellite gears constantly meshed with said winding members and mounted so as to be rotatable around their axles on said disk; a stationarytoothed sector arranged coaxially with said disk; said satellite gears engaging said toothed sector for rotating together with said winding members, when displaced by said disk, around this toothed sector, whereby, along the entire line of interaction of the toothed sector with the satellite gears, a zone of winding of the weft thread is formed; a device for retaining said winding members in a preset position after the satellite gears disengage from said toothed sector including a stationary fixing sector installed diametrically opposite said toothed sector and lugs mounted on said satellite gears and cooperating, when the latter are shifted by said disk, with the periphery of the fixing sector; a device for gradual starting of the winding members and stopping them in a predetermined position including two cams, one of which is intended for gradual starting of said satellite gears with the winding members and is stationary above the portion wherein the satellite gears change over from the fixing sector to said toothed sector and the other cam is intended for gradual stopping of said satellite gears with the winding members and is stationary above the portion wherein the satellite gears change over from said toothed sector to the fixing sector, and a plurality of pairs of pins according to the number of said winding members, each pair being mounted on each said satellite gear, one pin of the pair being adapted to cooperate with the cam for starting at the beginning of winding of the weft thread, and the other pin of the pair being adapted to cooperate with the cam for stopping at the end of winding of the weft thread onto the spools of the carriers.

2. An apparatus as claimed in claim 1, wherein the cams for starting and stopping of said device for gradual starting and stopping of the winding members in a predetermined position and respective pins of the pairs of this device are arranged in different planes relative to said toothed sector.

3. An apparatus as claimed in claim 1, wherein the cams for starting and stopping of said device for gradual starting and stopping of the winding members in a predetermined position are made as strips extending in horizontal planes, guiding slots made on the lower face plane of these strips being intended for respective pins of the pairs of said satellite gears.

4. An apparatus as claimed in claim 3, wherein said guiding slots of the strips have a length and a shape chosen so that said winding members are accelerated and decelerated and fixed in a predetermined position for said satellite gears to engage said toothed sector without impacts.

5. An apparatus as claimed in claim 1, wherein said fixing sector is seated below said toothed sector on an axle common for both of them.

6. An apparatus as claimed in claim 1, wherein the lugs of said device for retaining the winding members in a preset position mounted on the satellite gears are formed by at least two freely rotating rollers mounted on the lower end face of said satellite gears.

* * * * *